United States Patent [19]

Ishii

[11] Patent Number: 5,012,421

[45] Date of Patent: Apr. 30, 1991

[54] VEHICLE CONTROL APPARATUS

[75] Inventor: Mitsuaki Ishii, Hyogo, Japan

[73] Assignee: Mitsubishi Denki K. K., Tokyo, Japan

[21] Appl. No.: 344,526

[22] Filed: Apr. 27, 1989

Related U.S. Application Data

[63] Continuation of Ser. No. 124,522, Nov. 24, 1987, abandoned.

[30] Foreign Application Priority Data

Nov. 24, 1986 [JP] Japan ..... 61-280419

[51] Int. Cl.[5] ..... F02B 3/00

[52] U.S. Cl. ..... 364/431.10; 364/431.04; 364/431.06; 123/479; 123/440; 123/489

[58] Field of Search ..... 364/431.04, 431.05, 364/431.10, 431.11, 431.06; 123/440, 479, 480, 489

[56] References Cited

U.S. PATENT DOCUMENTS

| | | | |
|---|---|---|---|
| 4,213,180 | 7/1980 | Marchak et al. | 364/431.11 |
| 4,214,308 | 7/1980 | Carp | 364/431.05 |
| 4,357,922 | 11/1982 | Rosenzopf et al. | 123/491 |
| 4,383,409 | 5/1983 | Otsuka et al. | 123/479 |
| 4,386,427 | 5/1983 | Hosaka | 371/11 |
| 4,399,792 | 8/1983 | Otsuka et al. | 123/489 |
| 4,434,764 | 3/1984 | Hasegawa et al. | 123/489 |
| 4,450,812 | 5/1984 | Otsuka et al. | 123/440 |
| 4,587,615 | 5/1986 | Takahashi | 364/431.11 |
| 4,674,459 | 6/1987 | Blocher et al. | 364/431.05 |
| 4,780,826 | 10/1988 | Nakano et al. | 364/431.11 |

FOREIGN PATENT DOCUMENTS

| | | | |
|---|---|---|---|
| 0206636 | 11/1984 | Japan | 123/489 |
| 0116044 | 6/1986 | Japan | 123/489 |

OTHER PUBLICATIONS

"Electronic Emission Control Diagnoses its Own Problems" 8/1980 Society of Automotive Engineers.

*Primary Examiner*—Parshotam S. Lall
*Assistant Examiner*—V. Trans
*Attorney, Agent, or Firm*—Sughrue, Mion, Zinn, Macpeak & Seas

[57] ABSTRACT

A control apparatus for a motor vehicle which can be quickly unit tested during manufacture. Normally, the control apparatus processes signals from various operating condition sensors and applies them to determine the values of control signals to respective controlled elements, wherein there is a delay between the starting of the engine and the use of one of the sensors, namely, the exhaust gas $O_2$ sensor in determining the value of the respective control signal. To test the apparatus, signals simulating the outputs of at least one of the sensors are set to states which are improbable in acutal operation. Upon detecting such a condition, the control apparatus removes the delay from the starting of the engine and immediately applies all output signals from the sensors to determine their respective control signals.

5 Claims, 5 Drawing Sheets

VEHICLE CONTROL APPARATUS

This is a continuation of application Ser. No. 07/124,522, filed Nov. 24, 1987 now abandoned.

BACKGROUND OF THE INVENTION

The present invention relates generally to a control apparatus for a vehicle, and more particularly to a vehicle control apparatus in which testing of the control apparatus can be carried out in a short time.

Conventionally, there has generally been used an engine control apparatus in which the oxygen concentration in the exhaust gas is detected by an $O_2$ sensor mounted in the exhaust pipe. After the engine is warmed up, the output of the sensor is used to feedback-control the fuel supply rate so as to hold the air-fuel ratio at the theoretical value ($\lambda=1$). Such feedback control is not used, however, until the engine has been warmed up. Prior to the engine being warmed up, the fuel supply rate is held at a fixed, predetermined value. Such a system is disclosed, for example, in Japanese Unexamined Patent Publication No. 117828/1979.

Air-fuel feedback control using the $O_2$ sensor is also not performed in cases other, for example, during starting, deceleration, and running under high-load conditions.

Referring now to FIGS. 1 and 2, a description will be provided of a general example of a conventional vehicle control apparatus. FIG. 1 is a block diagram showing the overall arrangement of an air-fuel ratio control system. In this drawing, the air-fuel ratio control system is constituted by a control apparatus 1, a sensor power source line 21, a throttle opening sensor 22 constituted by a variable resistor for converting the throttle opening into a voltage signal, a coolant temperature sensor 23 using a thermistor, and a sensor ground line 24.

The sensor power source line 21, the throttle opening sensor 22, and the sensor ground line 24 are connected in series with each other between terminals 141 and 144, and a movable terminal of the throttle opening sensor 22 is connected to a terminal 142. The coolant temperature sensor 23 is connected to a terminal 143.

An $O_2$ sensor 25, an ignition coil 26, and an idling switch 28 are connected to terminals 145, 146, and 147, respectively.

The $O_2$ sensor 25 detects the oxygen concentration in the exhaust gas. An igniter 27 is provided for controlling the ignition coil 26. The ignition coil 26 and igniter 27 are connected in series with each other between a power source and ground. The idling switch 28 detects the state where the throttle is not depressed.

A power source circuit 109 is provided for supplying power to the throttle opening sensor 22 and various other portions of the control apparatus 1, the output terminals of the power source circuit 109 being connected to ground through a series connection of resistors 106 and 107. The resistors 106 and 107 constitute a resistor network together with the coolant temperature sensor 23 used to convert the coolant temperature to a voltage signal.

The terminals 142, 143, 145, 146 and 147 are connected to the input terminals of input interface circuits 101, 108, 103, 104, and 105 (hereinafter simply referred to as input I/Fs), respectively. The input I/F 108 constitutes an input I/F 102 together with resistors 106 and 107. Each of the input I/Fs 101 through 105 and 108 is constituted by a filter circuit for eliminating noise components, etc.

The outputs of the input I/Fs 101, 108, and 103 are applied to an A/D (analog-to-digital) converter 110, while the outputs of the input I/Fs 104 and 105 are applied to a microcomputer 120.

The A/D converter 110 converts the analog voltage signals produced by the input I/Fs 101, 103 and 108 into digital signals, which are transferred to the microcomputer 120.

The microcomputer 120 is provided with a RAM (random access memory) 121 and a ROM (read-only memory) 122. Output signals of the microcomputer 120 are amplified by output interface circuits 131, 132 and 134 (hereinafter simply referred to as output I/Fs), and applied to a fuel control solenoid 301 and other solenoids 302 and 303 through terminals 151 through 153, respectively.

The fuel control solenoid 301, incorporated in a carburetor, controls the air-fuel ratio on the basis of the controlled value of its duty cycle. The solenoids 301 and 303 control the exhaust gas flow.

Next, the operation of the control apparatus 1 of FIG. 1 will be described. The microcomputer 120 is supplied with digital signals obtained by digitally converting the respective outputs of the throttle opening sensor 22, the coolant temperature sensor 23, and the $O_2$ sensor 25 by the A/D converter 110 so as to thus read input information from the sensors 22, 23 and 25.

The microcomputer 120 is supplied with an interrupt signal for the ignition coil 26 through the terminal 146 and the input I/F 104 to thereby permit it to measure the ignition timing interval and to convert the ignition timing interval into a value indicative of engine rotation speed, which is utilized for various control purposes.

Further, the microcomputer 120 judges the ON/OFF state of the idling switch 28 on the basis of an input voltage.

The states of the control signals for the fuel control solenoid 301 and the solenoids 301 and 303 are determined by the microcomputer 120 on the basis of the foregoing input information and in accordance with a procedure stored in the ROM 122. The solenoids 302 and 303 are turned off when the engine speed exceeds a predetermined value.

The fuel control solenoid 301, on the other hand, is controlled on the basis of the flowchart of FIG. 2. Referring to FIG. 2, in step 401, when the engine speed is not larger than 400 r.p.m., it is judged that the engine is being cranked for starting. When the engine is in this state, a predetermined controlled duty-cycle value for starting is produced as a control quantity in step 402.

In the microcomputer 120, the duty-cycle value is converted into a pulse signal using a well-known timer interrupt procedure so as to control the duty-cycle of the fuel control solenoid 301.

Similar to the above case, when the duty-cycle value for controlling the fuel control solenoid 301 is set, the duty-cycle value is converted into a pulse signal by the timer interrupt processing.

The state of engine deceleration is detected from the engine speed and the output of the idling switch 28 in the step 403, and if the engine is decelerating, a control duty-cycle value for deceleration is set as the control quantity for the deceleration state in step 404. On the basis of the engine speed and the output of the throttle opening sensor 22, a judgment is made as to whether the engine is operating in the enriched zone (high-load running conditions) in step 405, and if so, a control duty-cycle value appropriate for the enriched zone is set in step 406.

The fact that the engine is running cold, that is, that the temperature of the coolant is low, is detected on the basis of the output of the coolant temperature sensor 23 in step 407, and if a low coolant temperature is detected, a suitable predetermined control duty-cycle value is set in step 408.

Judgment is made as to whether a time $T_1$ (sec) has elapsed after starting of the engine in step 409, and if $T_1$ has not elapsed after engine starting, a predetermined control duty-cycle value for this initial running period is set in step 410.

When the operation shifts from step 409 to step 411, normal air-fuel ratio feedback control by the $O_2$ sensor 25 is performed to thereby determine the control duty-cycle value using the well-known technique of proportional integral control so as to hold the air-fuel ratio at the theoretical value.

To test the control apparatus 1 described above as an independent unit, a signal is applied to the input terminal of the control apparatus 1 and the resulting output signal produced upon the output terminals of the control apparatus 1 is detected. Thus, it is generally possible to confirm that the control apparatus 1 has correctly processed the input signal and correctly controlled the fuel control solenoid 301 and the solenoids 301 and 303. (The solenoids 302 and 303 can be turned on/off by changing the engine speed.)

Further, in steps 401 through 408 discussed above, it is possible to confirm that the input information, except for that provided by the $O_2$ sensor 25, has been correctly read by applying simulated signals for those sensors to the terminals 141 through 147, thereby making it possible to test whether or not the control apparatus 1 is correctly operating within a short period of time. The operation of the fuel control solenoid 301 can also be confirmed in this manner.

In order to test the control operation of the $O_2$ sensor 25, however, it is necessary that step 411 above be reached. That is, in order to confirm the operation of the $O_2$ sensor 25 and to confirm the fact that the output of the $O_2$ sensor 25 has been correctly read, in step 411, it is necessary that time $T_1$ has elapsed after starting (step 409).

However, for mass production, it is necessary to shorten the unit test time for each product. In the case of the foregoing control apparatus, however, the test time is increased by $T_1$, and therefore there has been a problem in that the mass-production of such control apparatus is lengthened, and consequently the cost increased.

SUMMARY OF THE INVENTION

It is therefore an object of the present invention to solve the foregoing problem in the prior art.

It is another object of the present invention to provide a vehicle control apparatus of high quality in which the limit test time of the control apparatus is shortened.

In order to attain the above objects, a vehicle control apparatus constructed according to the present invention is provided with state detection means for detecting when at least one of the output signals from the various sensors is in an improbable state, and means for processing the outputs of the sensors to produce in response thereto control signals for respective controlled elements, wherein normally there is a predetermined delay interval from the time of engine starting until at least one sensor output is applied to form the control signal for the respective controlled element, and when said state detection means detects that said at least one of said outputs is in said improbable state, the predetermined time interval is reduced or eliminated. With this arrangement, during unit testing of the apparatus, by applying test signals which simulate the conditions under which the state detection means detects the improbable state, the predetermined delay time interval is reduced or eliminated, making it possible to complete the testing of the apparatus in a significantly shortened period.

BRIEF DESCRIPTION OF THE DRAWINGS

The present invention will be apparent from the following detailed description taken in conjunction with the accompanying drawings, in which.

DESCRIPTION OF THE PREFERRED EMBODIMENTS

A preferred embodiment of a vehicle control apparatus constructed according to the present invention will now be described with reference to the accompanying drawings.

Figure 3:
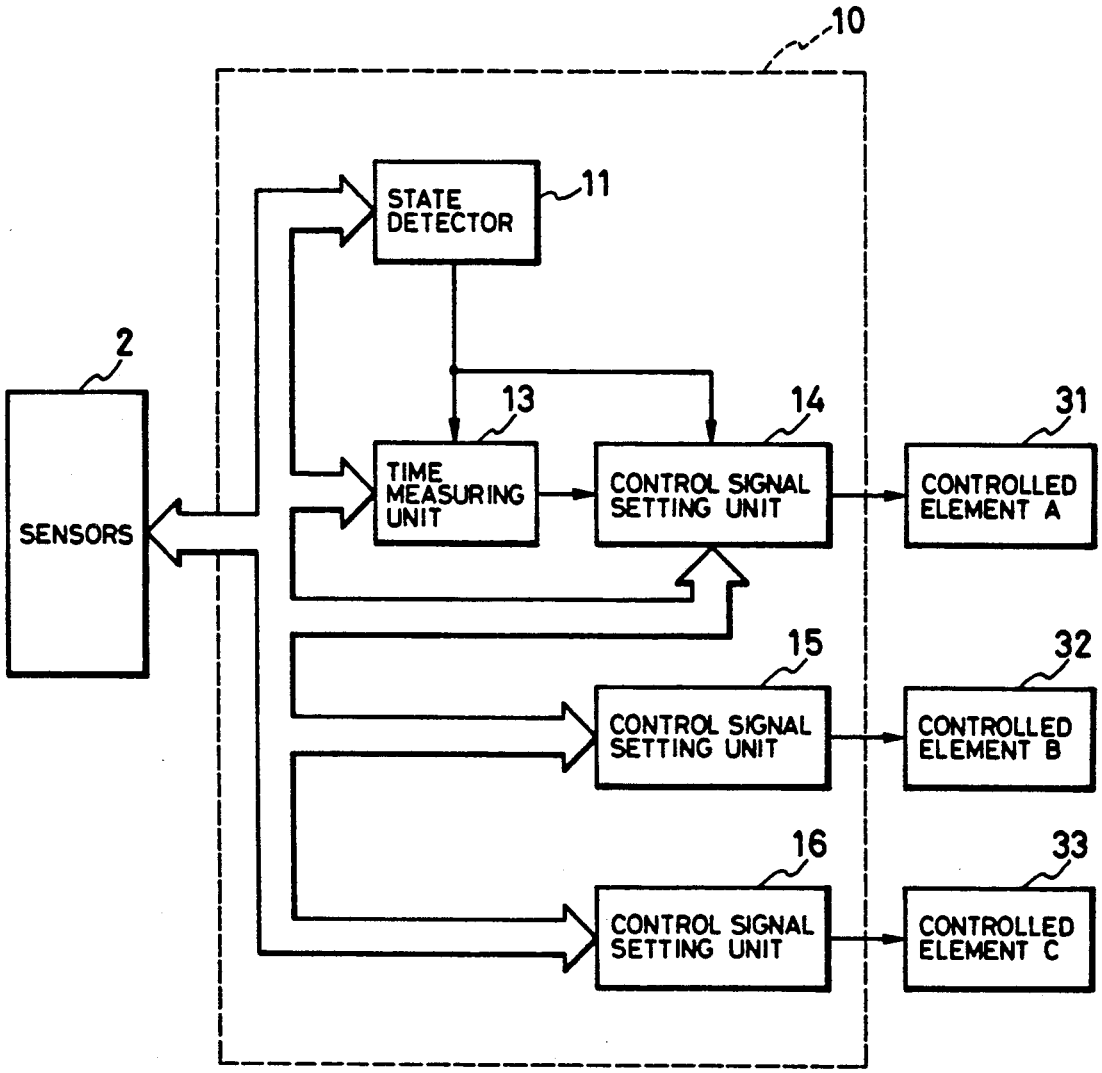
FIG. 3 is a functional block diagram showing a preferred embodiment of a vehicle control apparatus constructed according to the present invention.

FIG. 3 is a functional block diagram showing a preferred embodiment of the present invention. In FIG. 3, a control apparatus 10 using a microcomputer is connected to a plurality of sensors 2, shown only in block form in FIG. 3, which detect respective operating conditions at various portions of the vehicle. The outputs of the control apparatus 10, applied to controlled elements 31 through 33, are determined on the basis of the respective outputs of the sensors 2.

The control apparatus 10 is provided with a state detector 11 for detecting when any of the sensors 2 is producing an improbable output signal, a time measuring unit 13 for measuring a time interval during which information from at least one of the sensors 2 is not being applied to control the corresponding controlled element 31, a control signal setting unit 14 for establishing control signal values for the controlled elements 31 in accordance with a previously stored procedure and on the basis of the respective output signals of the sensors 2, the state detector 11 and the time measuring unit 13, and further control signal setting units 15 and 16 for establishing control signal values for the controlled elements 32 and 33, respectively, in accordance with a predetermined procedure and on the basis of the output states of the sensors 2.

Data are transferred between the sensors 2 and each of the state detectors 11, the time measuring unit 13 and the control signal setting units 14, 15 and 16. The output of the state detector 11 is applied to the time measuring unit 13 and the control signal setting unit 14, and the output of the time measuring 13 is applied to the control signal setting unit 14. The respective outputs of the control signal setting units 15 and 16 are applied to the controlled elements 32 and 33, respectively.

The operation of this vehicle control apparatus according to the present invention will now be described.

The control detector 14 normally executes predetermined control operations on the basis of the outputs of sensors 2 and the time measuring unit 13. However, once any of the sensors 2 has produced a signal in an improbable state, and such has been detected by the state detector 11, the control signal setting unit 14 immediately assumes control in accordance with the output signals of the sensors 2 and independently of the output of the time measuring unit 13.

Figure 2:
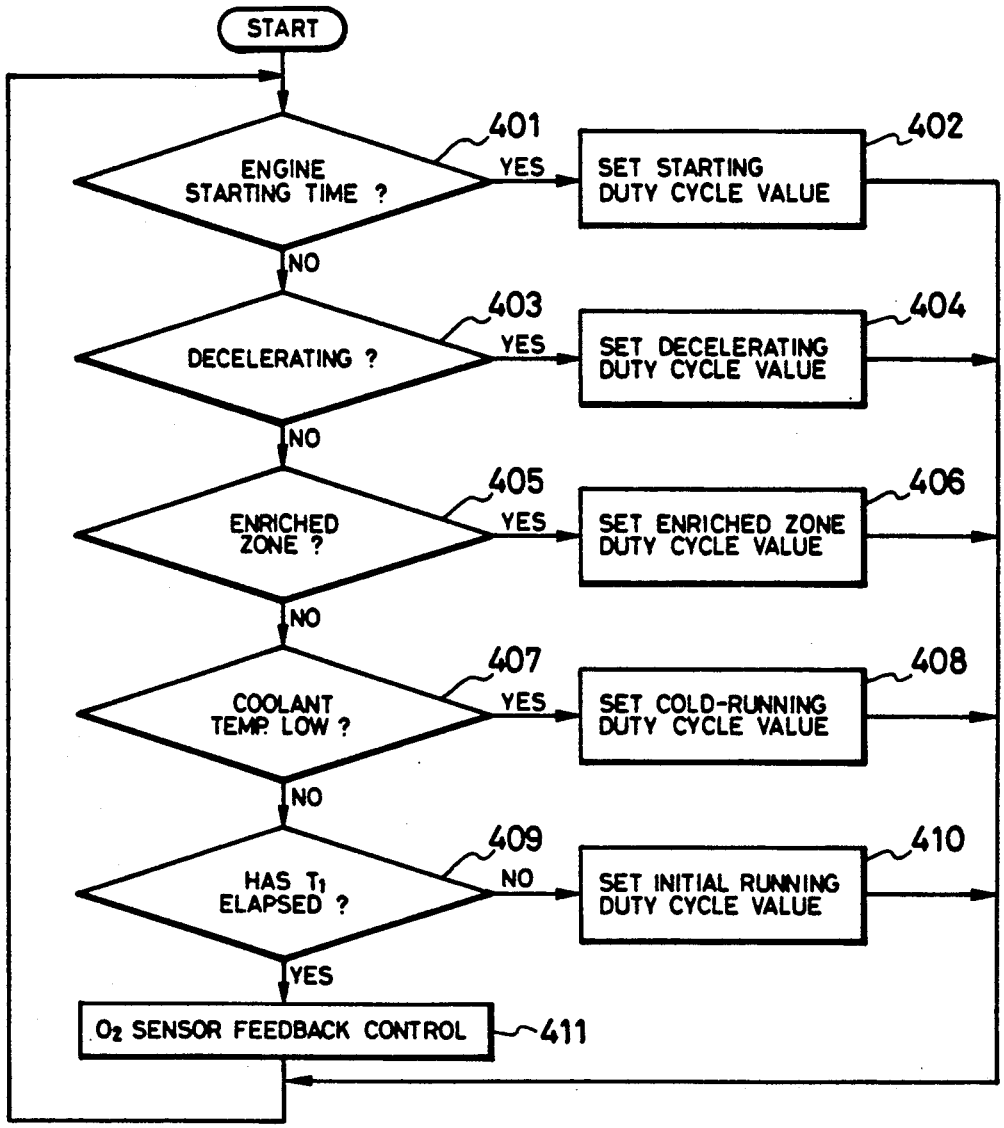
FIG. 2 PRIOR ART
FIG. 2 is a flowchart used for explaining the operation of the air-fuel ratio control system of FIG. 1.
Figure 4:
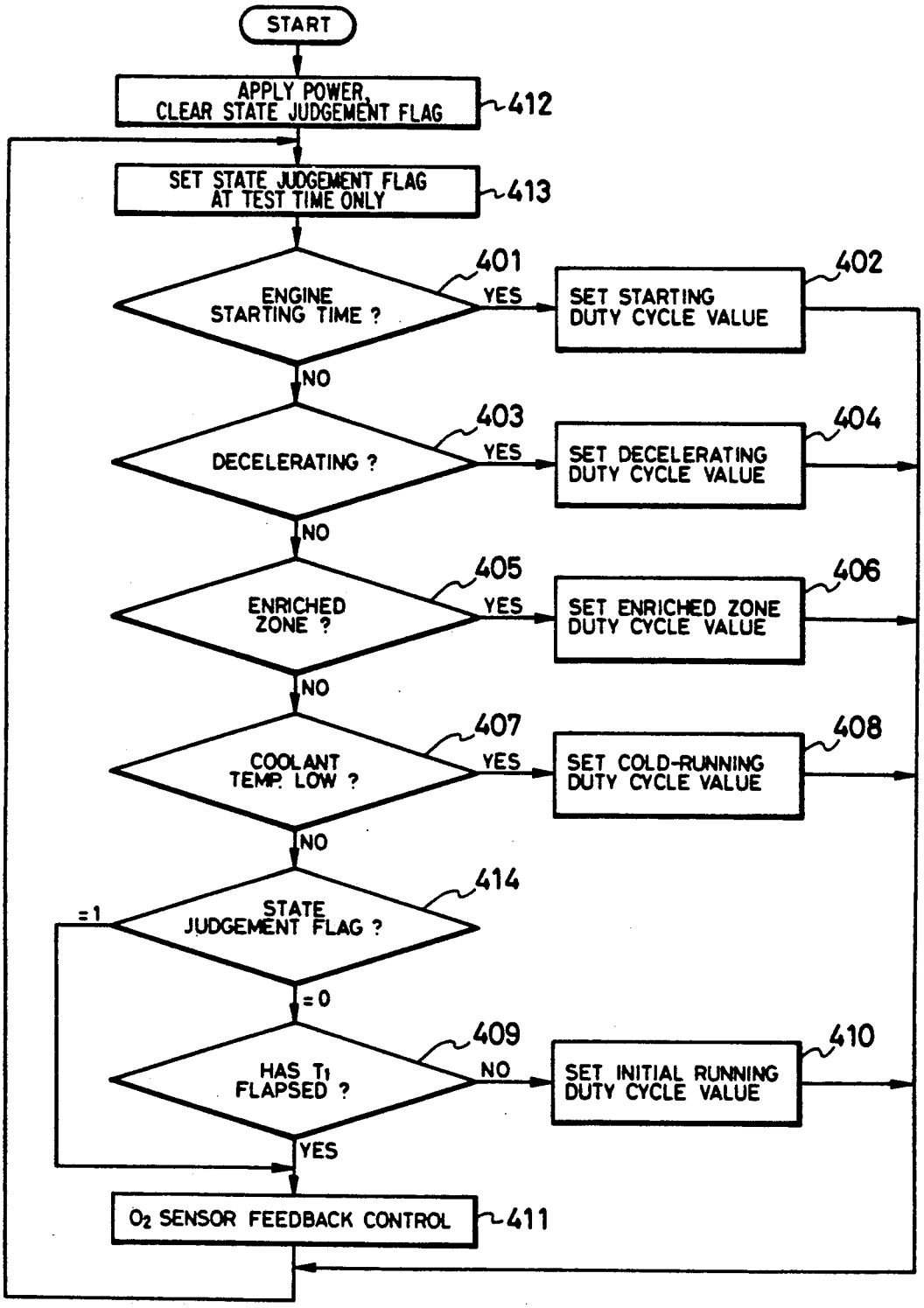
FIGS. 4 and 5 are flowcharts provided for explaining the operation of the vehicle control apparatus of FIG. 3.
Figure 5:
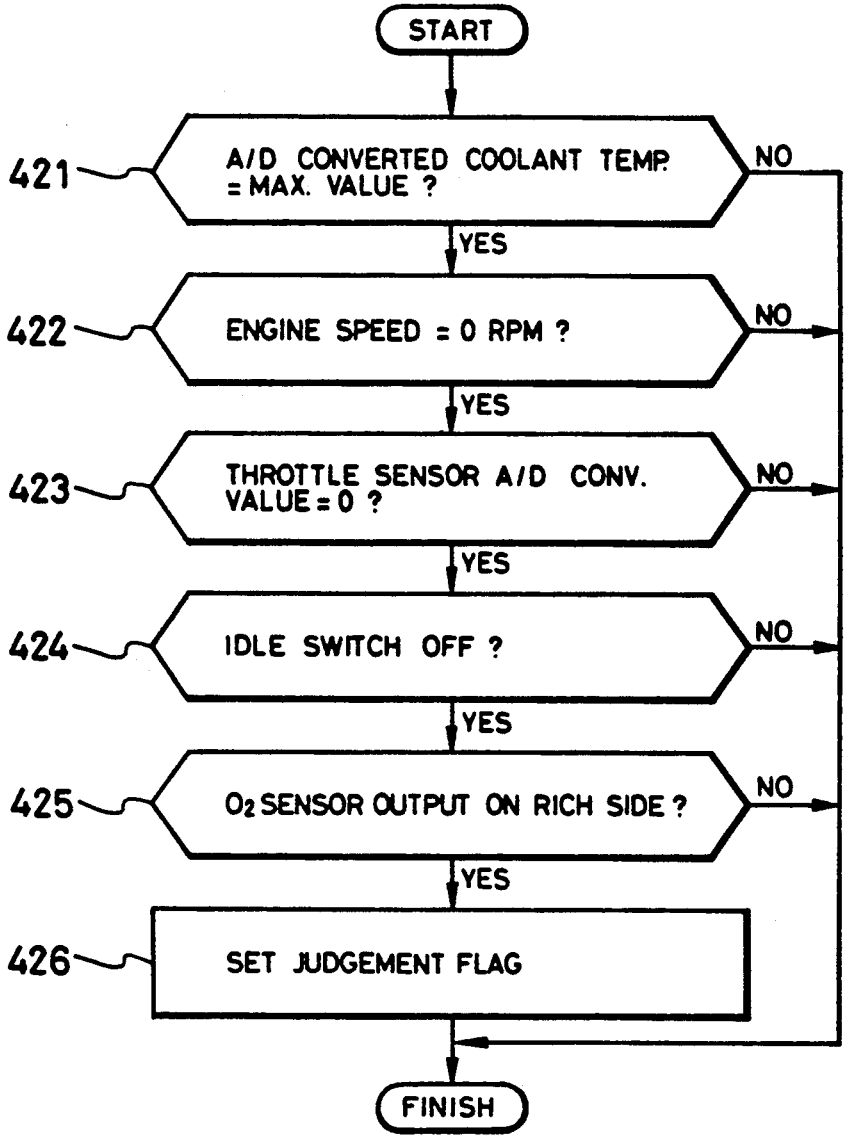

FIGS. 4 and 5 are flowcharts used for explaining the operation of the vehicle control apparatus of FIG. 3. In FIG. 4, steps the same as those of FIG. 2 are correspondingly referenced.

In FIG. 4, a state judgment flag (to be used in step 414) is cleared when a power source voltage is applied to the control apparatus 10 in step 412.

When it is detected that each of the sensors 2 is producing a signal which is actually improbable in ordinary operation of the vehicle, the state judgment flag is set in step 413.

Referring to FIG. 5, a detailed description will be given of the processing of step 413.

Figure 1:
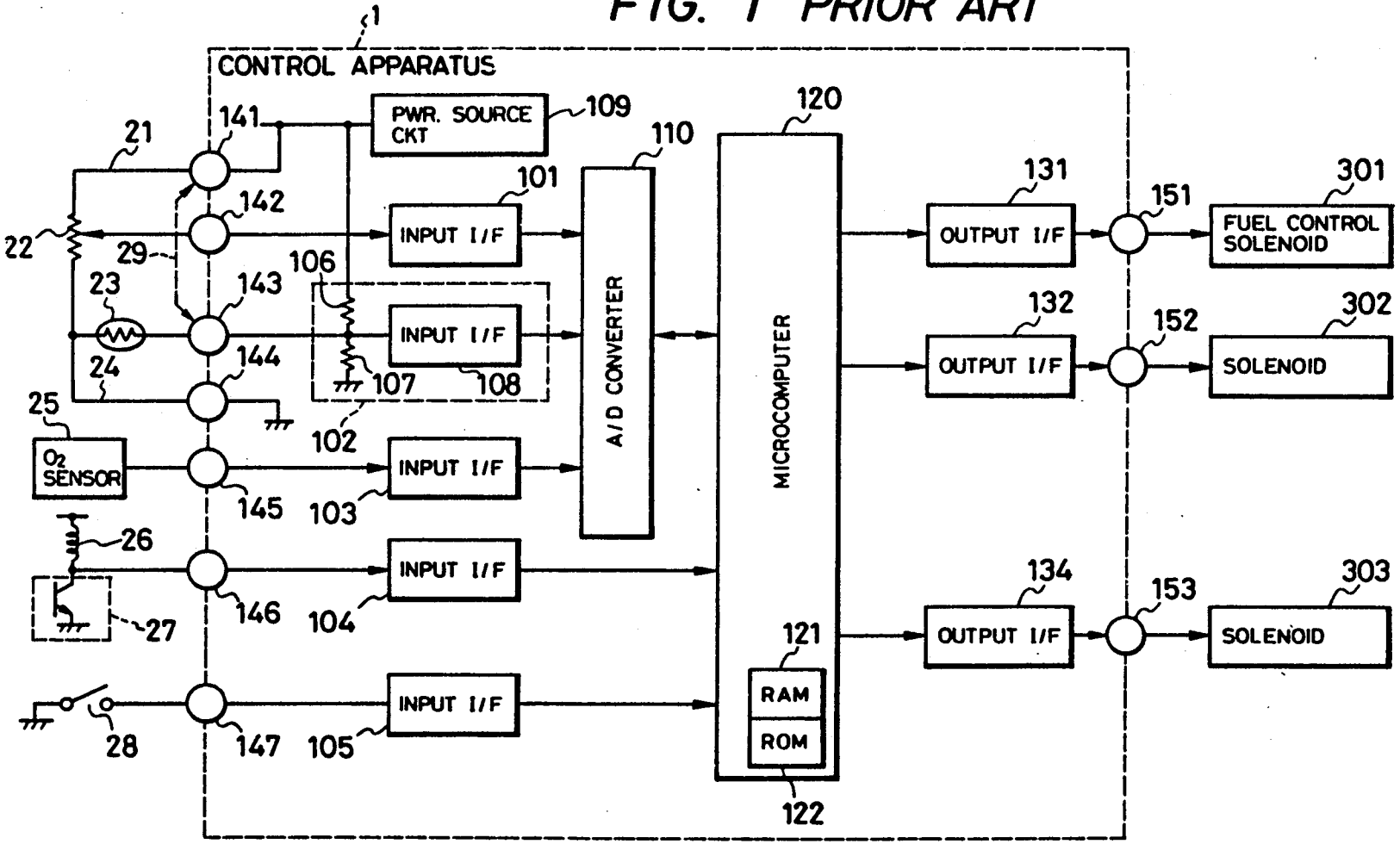
FIG. 1 PRIOR ART
FIG. 1 is a block diagram showing a conventional air-fuel ratio control system.

When the control apparatus 10 is tested as an independent unit, the terminals 141 and 143 are temporarily shorted to each other using a test jumper line 29 as shown by a broken line in FIG. 1. Normally, the voltage applied to the terminal 143 is obtained by dividing the sensor supply voltage with the resistors 106 and 107 and the coolant temperature sensor 23, and therefore the voltage at the terminal 143 is always lower than the sensor supply voltage. When the terminals 141 and 143 are shorted to each other as described above, however, the voltage at the terminals 143 becomes equal to the sensor supply voltage, which is a value improbable in normal operations.

In FIG. 5, the operation is advanced from step 421 to step 422 only when an A/D-converted value of the coolant temperature sensor 23 is equal to the sensor supply voltage, that is, the maximum value, in step 421. In other cases, the operation does not pass through step 426 in which the state judgment flag is set. That is, the state judgment flag is set in step 426 only when the sensor output signals simultaneously indicate that the engine speed is zero r.p.m. in step 422, the throttle is fully closed (the corresponding A/D-converted value is zero) in step 423, the accelerator is depressed (the idling switch 28 is in the off state) in step 424, and the output signal of the $O_2$ sensor 25 is not smaller than a rich-state detection voltage in step 425.

Hence, when the control apparatus 10 is to be unit tested, because it is readily possible to apply independent test signals to the terminals 141 through 147, it is easy to establish all the conditions shown in FIG. 5.

That is, in testing the control apparatus 1, input information can be applied so as to temporarily establish all the conditions of steps 421 through 425 of FIG. 5 immediately after the start of testing. As a result, the state judgment flag is immediately set.

Steps 401 through 411 in FIG. 4 are the same as those in FIG. 2, and therefore a further explanation those steps is omitted.

If the state judgment flag is in the cleared state in step 414, the operation shifts from step 414 to step 409 in which normal control of the air-fuel ratio is performed in the same manner as in the case of FIG. 2. If the state judgment flag is in the set state in step 414, step 409 is not executed, and $O_2$ feedback control (step 411) is immediately carried out.

As described above, in testing the inventive control apparatus 10, the output of the $O_2$ sensor can be immediately applied to control the fuel control solenoid 301 as soon as the engine has been started. Therefore, even in the case where the control apparatus must be arranged in such a manner that, during normal operation, some specific input cannot be employed for control for a predetermined time, all the input information can be correctly read immediately after power is applied, and hence it is possible to confirm the operations of all controlled elements in a short time.

Although a description has been given as to the case where it is the output of the $O_2$ sensor which ordinarily causes no effect on its controlled element for a predetermined time after the engine has been started, the present invention can be applied to any sensor input or controlled element.

Further, the test time can be shortened instead of eliminated by making the setting time $T_1$ after engine starting short in setting the state judgment flag.

As described above, according to the present invention, even in the case where the control apparatus includes control logic according to which sensor output information cannot be reflected in the control signal to the respective controlled element for a predetermined time, by applying to the control apparatus a set of sensor output signals in states improbable in normal operation, the sensor output information can be immediately reflected in the control signal to the controlled element without having to wait the predetermined time. As a result, the invention makes it possible to accurately perform unit testing of the control apparatus in a short time.

What is claimed is:

1. A control apparatus for a vehicle, which apparatus can be rapidly tested prior to being placed in normal use, comprising:

a plurality of sensors for detecting respective operating conditions at various portions of said vehicle, including an engine of said vehicle;

a plurality of controlled elements operated in response to output signals of said sensors;

time measuring means for measuring a fixed time interval from a predetermined point in time;

state detection means for detecting when an output signal of at least one of said sensors is in a predetermined improbable state which would not occur in normal operation of said control apparatus after said apparatus has been placed in normal use; and control determination means for reading output information from said sensor and processing said information in accordance with a predetermined procedure, with the output information of at least a first one of said sensors normally having no effect on the respective controlled element for said time interval measured by said time measuring means, said control determined means, upon detection of said improbable state which would not occur in normal operation by said state detection means, applying the output information of said first sensor to control said respective controlled element independently of said time determined by said time measuring means, and prior to the elapse of said time interval.

2. The control apparatus of claim 1, wherein said at least one of said sensors is an $O_2$ sensor for sensing oxygen content in an exhaust gas of said engine.

3. The control apparatus of claim 1, wherein said state detection means is set when output signals of a plurality of said sensors are in respective improbable states.

4. The control apparatus of claim 3, wherein said improbable states comprise an output of a coolant temperature sensor indicating a maximum coolant temperature, an engine speed sensor indicating a zero engine speed, a throttle position sensor indicating a zero value, an idle switch sensor indicating an off position of an idle switch, and an $O_2$ sensor for sensing an oxygen content in an exhaust gas of said engine indicating a rich air/fuel mixture.

5. A control apparatus for a vehicle engine, which apparatus can be rapidly tested prior to being placed in normal use, comprising:

a plurality of sensors for detecting vehicle operation conditions, including an oxygen sensor arranged in an exhaust system of said vehicle;

control means for controlling operation of said vehicle engine in response to outputs of said sensors;

timer means for inhibiting said control means from responding to at least the output of said oxygen sensor for a predetermined time following starting of said engine to allow said engine to warm up in normal use; and means for defeating said timer means during testing of said control apparatus to cause said control means to respond to said output of said oxygen sensor without waiting for said engine to warm up, said means for defeating said timer comprising means for setting a flag upon the occurrence of several sensor outputs which would not occur in normal operation of said control apparatus after said apparatus has been placed in normal use.

* * * * *